US006622956B2

(12) United States Patent
Tone

(10) Patent No.: US 6,622,956 B2
(45) Date of Patent: Sep. 23, 2003

(54) TAKE-UP WINDER

(75) Inventor: Shoichi Tone, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/975,511

(22) Filed: Oct. 12, 2001

(65) Prior Publication Data

US 2002/0053623 A1 May 9, 2002

(30) Foreign Application Priority Data

Nov. 8, 2000 (JP) ..... 2000-339788
Apr. 25, 2001 (JP) ..... 2001-127991

(51) Int. Cl.[7] ..... B65H 54/22; B65H 67/048

(52) U.S. Cl. ..... 242/474.5; 242/486.4; 242/486.8

(58) Field of Search ..... 242/486.4, 486.1, 242/486.8, 474.5, 474.6, 157 R, 477.1

(56) References Cited

U.S. PATENT DOCUMENTS 5,016,829 A * 5/1991 Schippers et al.
5,407,143 A * 4/1995 Nakai et al.
5,526,995 A * 6/1996 Westrich et al.
5,605,294 A * 2/1997 Migaki et al.
6,062,505 A * 5/2000 Bartkowiak ..... 242/474.5 X
6,070,827 A * 6/2000 Spahlinger et al. ..... 242/474.5
6,076,760 A * 6/2000 Mayer ..... 242/474.5
6,105,896 A * 8/2000 Westrich ..... 242/474.5

FOREIGN PATENT DOCUMENTS

EP 0 567 091 A1 * 10/1993 ..... 242/476.6 X
JP 7-55764 6/1995
JP 8-26597 1/1996

* cited by examiner

*Primary Examiner*—Michael R. Mansen
(74) *Attorney, Agent, or Firm*—Armstrong, Westerman & Hattori, LLP

(57) ABSTRACT

The object of the present invention is to obtain a contact pressure control device capable of carrying out feedback control enduring a practical use by inventing a pressure detecting means and the employment structure of the same. The contact pressure control device of the take-up winder comprises a bobbin holder 5, a contact pressure roller 11 contacted against the bobbin B set on the bobbin holder 5, a slide supporting mechanism (s) for supporting the contact pressure roller 11 elevating or descending to the machine main body 2, and a contact pressure cylinder 13 freely adjusting the contact pressure of the contact pressure roller 11 and the bobbin holder 5. Moreover, a load cell 16 is provided directly below one contact pressure cylinder 13 located between a pair of slide supporting mechanisms (s), (s). Furthermore, a print circuit board for controlling is provided for controlling the contact pressure cylinder 13 based on the detected value of the load cell 16 so that the contact pressure is to be maintained at a designated value.

7 Claims, 15 Drawing Sheets

TAKE-UP WINDER

FIELD OF THE INVENTION

The present invention relates to a take-up winder for winding a yarn produced by a melt-spinning machine, specifically to the technology for accurately maintaining a contact pressure of a bobbin holder for winding yarn and a contact pressure roller rotating following the contact with the bobbin holder, at a designated value by a feedback control.

BACKGROUND OF THE INVENTION

According to such kind of take-up winder, in the process of forming a package by winding the yarn to a bobbin set on a bobbin holder, the bobbin holder rotates at a high speed, and to make the quality of the yarn to be in a favorable condition by a stable winding, a contact pressure of a contact pressure roller and the package, in other words, a control to adjust the contact pressure is necessary. For a contact pressure control device for such purpose, take-up winders publicized in the Japanese Patent Publication (Tokkou-Hei) No. 7-55764 or the Japanese Unexamined Patent Application Publication (Tokkai-Hei) No. 8-26597 are known.

These take-up winders comprised a pressure detecting means such as a strain sensor for detecting load of a bearing section which supports the contact pressure roller in rotatable form, and adopted a control structure to control the contact pressure applied to the package of the contact pressure roller to be at a targeted value by feeding back the detected value of the pressure detecting means.

According to the take-up winders shown in aforementioned publications, the contact pressure is attempted to be maintained at the target value (or target range) accurately by carrying out a desired feedback control. However, it can be predicted that an expected operation cannot be earned with such means. In other words, a bobbin holder inserted with a plurality of bobbin is supported in cantilever to a machine main body so that the exchanging of packages can be carried out easily, and rotated and driven at a high speed under such condition. Therefore, vibration accompanying rotation generates at all times, the change in the load of the contact pressure roller is intense, and a total of one pair of pressure detecting means is required to both ends of the contact pressure roller. Moreover, some processing means is necessary for handling the detected value of both pairs as one data. Therefore, the control accuracy enduring a practical use cannot be realized.

To solve such problems, corresponding the detected values of the pressure detecting means of the left and the right and suppressing a generation of a change can be proposed as a solution. However, to make the rigidity of the bobbin holder of cantilever support structure to endure the change is a difficult task. Thus, there was a room for improvement for realization of a feedback control with high accuracy and enduring to a practical use.

The object of the present invention is to obtain a contact pressure control device capable of carrying out a feedback control enduring to a practical use by inventing a pressure detecting means and the employment structure of the same.

SUMMARY OF THE INVENTION

According to the present invention, the take-up winder comprises a bobbin holder which drives and rotates, a contact pressure roller rotatable following contact pressure of a bobbin set on the bobbin holder, a roller supporting means for supporting the contact pressure roller transferable in the direction contacting and separating from the bobbin, and a contact pressure adjusting mechanism capable of adjusting the contact pressure of the contact pressure roller and the bobbin holder. In the contact pressure control device of such take-up winder, a pressure detecting means for detecting the pressure acting on the contact pressure adjusting mechanism is provided, and a means for controlling the contact pressure adjusting mechanism based on the detected value of the pressure detecting means so that the contact pressure is to be maintained at a designated value is also provided.

The pressure detecting means detects the pressure acting on the contact pressure adjusting mechanism (such as a pneumatic cylinder which supports the contact pressure roller elevating or descending). The contact pressure adjusting mechanism is provided to be located to the base side than the bearing unit of the contact pressure roller in the supporting means of the contact pressure roller. Therefore, comparing to the conventional technology, the vibration accompanying the rotation following a contact with the bobbin holder or a package, is to be damped and a stable detected value can be earned.

The contact pressure adjusting mechanism is a fluid pressure cylinder bridged in the vertical direction between a machine main body which supports the bobbin holder rotatable, and the roller supporting means. The pressure detecting means is a load cell provided directly under the fluid pressure cylinder between the fluid air cylinder and the machine main body.

A roller supporting means for supporting the contact pressure roller is constructed to be held by a fluid pressure cylinder provided in the vertical direction, and a load cell is provided directly below the fluid pressure cylinder. Therefore, a relatively large load of both the roller supporting means and the fluid pressure cylinder act upon the load cell. As a result, comparing to the case in which detecting a minute load change, the fluctuation in detection can be grasped accurately.

The roller supporting means supports a transferring frame supporting the contact pressure roller rotatable which is located in the upper part of the bobbin holder, sliding vertically to the machine main body via a pair of slide supporting mechanism. One fluid pressure cylinder is provided between both slide supporting mechanisms.

Only one load cell is sufficient to be provided directly below the fluid pressure cylinder. Therefore, comparing to the case in which more than two load cells are used, the total cost can be suppressed, and a means for processing a plurality of detected values as one control data, as to average the plurality of the detected values, becomes unnecessary.

The roller supporting means supports a rear anchor of the transferring frame which supports the contact pressure roller rotatable, located in the upper part of the bobbin holder, rotatable to the machine main body. The fluid pressure cylinder is provided between the transferring frame and the machine main body.

The fluid pressure cylinder of short stroke is provided in between the middle of the rear anchor of the transferring frame and the contact pressure roller, and the machine main body. According to the principal of leverage, a relatively large load is acted upon the fluid pressure cylinder, and comparing to the case in which detecting a minute load change, the fluctuation in the detection can be grasped accurately.

When the fluid pressure cylinder is worked on a stroke end of either forward or backward, the forward or backward transferring amount of the fluid cylinder is set so that the total weight of the an elevating frame is to act upon the load cell.

The detail will be described in the following, however, in the stroke end state, the total weight of the weight of the entire elevating frame and the weight of the fluid pressure cylinder is to act upon the load cell provided directly below the fluid pressure cylinder. The total weight is a fixed value made clear by measuring beforehand for example. Therefore, by comparing the fixed value and the actual detected value, the zero-point correction of the load cell can be carried out.

DETAILED DESCRIPTION OF THE EMBODIMENTS

The embodiments of the present invention will be described in reference to the accompanying drawings.

Figure 4:
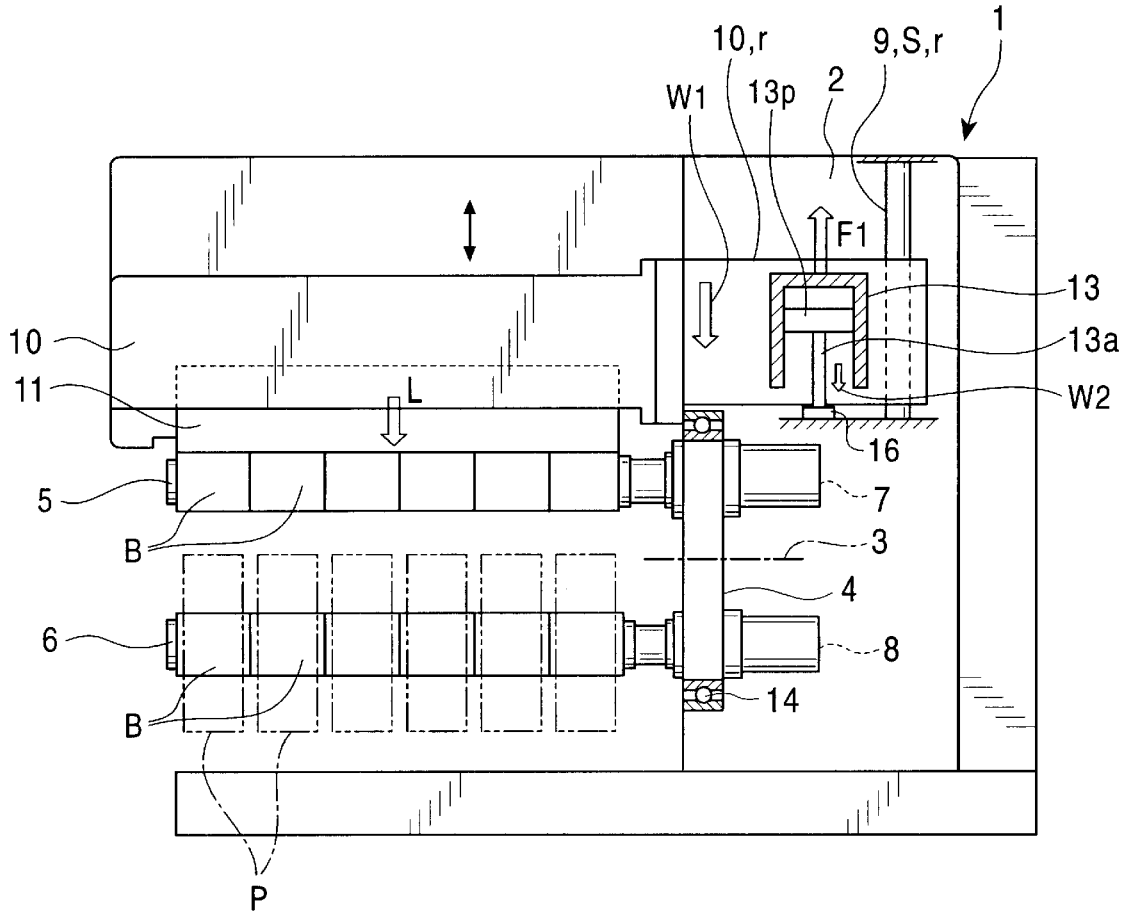
FIG. 4 is a side view of the take-up winder.
Figure 5:
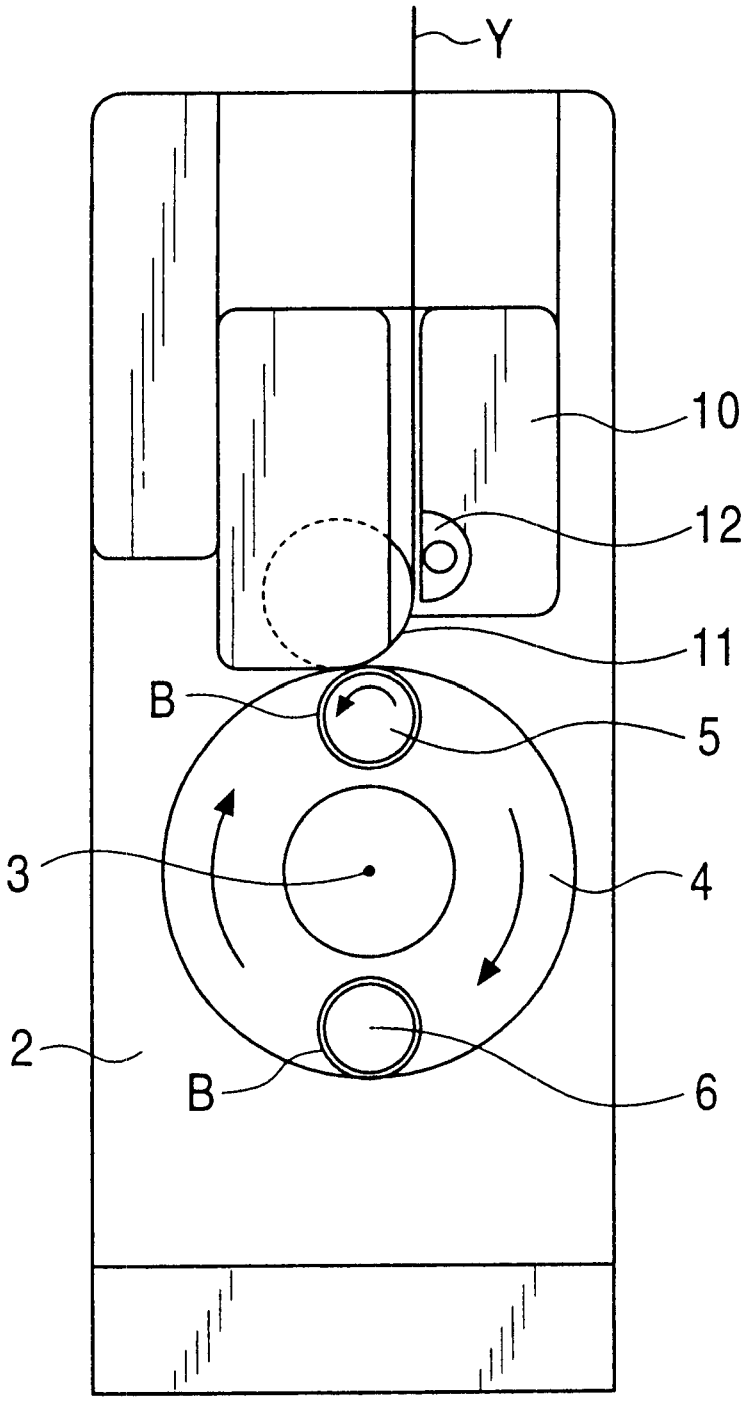
FIG. 5 is a front view showing the turret section.

As shown in FIG. 4 and FIG. 5, a take-up winder 1 for winding a yarn produced by a melt-spinning machine comprises a turret 4 rotating around the center shaft 3 to a machine main body 2, two bobbin holders 5, 6 projecting from the turret 4, induction motors 7, 8 for rotating and driving the bobbin holders 5, 6 fixed to the back of the turret 4, an elevating frame 10 as a transferring frame elevating or descending perpendicularly by being guided by a guide rod 9 in the machine main body 2, a contact pressure roller 11 supported by the elevating frame 10, and a traverse device 12 supported by the elevating frame 10.

The weight of the entire elevating frame 10 which supports the contact pressure roller 11 and the traverse device 12, is supported by a contact pressure cylinder 13 provided between the elevating frame 10 and the machine main body 2. The difference between this weight and the lifting force of the contact pressure cylinder 13 is made to be the contact pressure to a package P of the contact pressure roller 11. In other words, the elevating frame 10 which supports the contact pressure roller 11 rotating and contacting to the package P can elevate or descend to the machine main body 2 by the contact pressure cylinder 13. The contact pressure cylinder 13 adjusts the contact pressure applied to the package P.

In other words, the entire elevating frame 10 is capable of elevating according to the increase in the winding diameter of the package P formed by yarn wound to a bobbin B, while maintaining the contact pressure at a designated value. Moreover, by increasing the air pressure to the contact pressure cylinder 13, the entire elevating frame 10 can be elevated by being separated from the package P. Further, a slide supporting mechanism (s) is formed by the guide rod 9, and the roller supporting means is formed by the guide rod 9, the elevating frame 10, or the like.

The schematic operation of such take-up winder is as follows.

Referring to FIG. 5, the bobbin holder 5 is located at a winding position, in the upper side of the approximately vertical direction of the center shaft 3. The bobbin holder 6 is located at a standby position, in the lower side of the approximately vertical direction of the center shaft 3. When the package P at the winding position becomes full wound, the turret 4 rotates 180 degrees, the full wound package P is to be located at a standby position, and an empty bobbin B reaches the winding position and switched.

A yarn Y contacts to the empty bobbin B to be wound by the full wound package P, and by a threading device (not shown in the drawings), the yarn Y is transferred from the full wound package P to the bobbin B. Next, the rotation of the bobbin holder 6 at the standby position is stopped, the full wound package P is pushed out to a doffing cart (not shown in the drawings), and an empty bobbin B is set on the bobbin holder 6 at the same time. By the repetition of such operation, the yarn Y is wound continuously.

The bobbin holders 5, 6 are rotating bodies supported in a cantilever. Furthermore, the bobbin holders 5, 6 hold packages P of considerable weight formed by wound around the bobbins B, and a designated contact pressure is applied via the contact pressure roller 11. Therefore, a bearing 14 of the turret 4 supporting the bobbin holders 5, 6 rotatable, is provided in the front side as possible of the machine main body 2. As a result, the guide rod 9 and the contact pressure cylinder 13 are provided adjacent to the bearing 14 and displaced to the anti-bobbin holder side.

Figure 1:
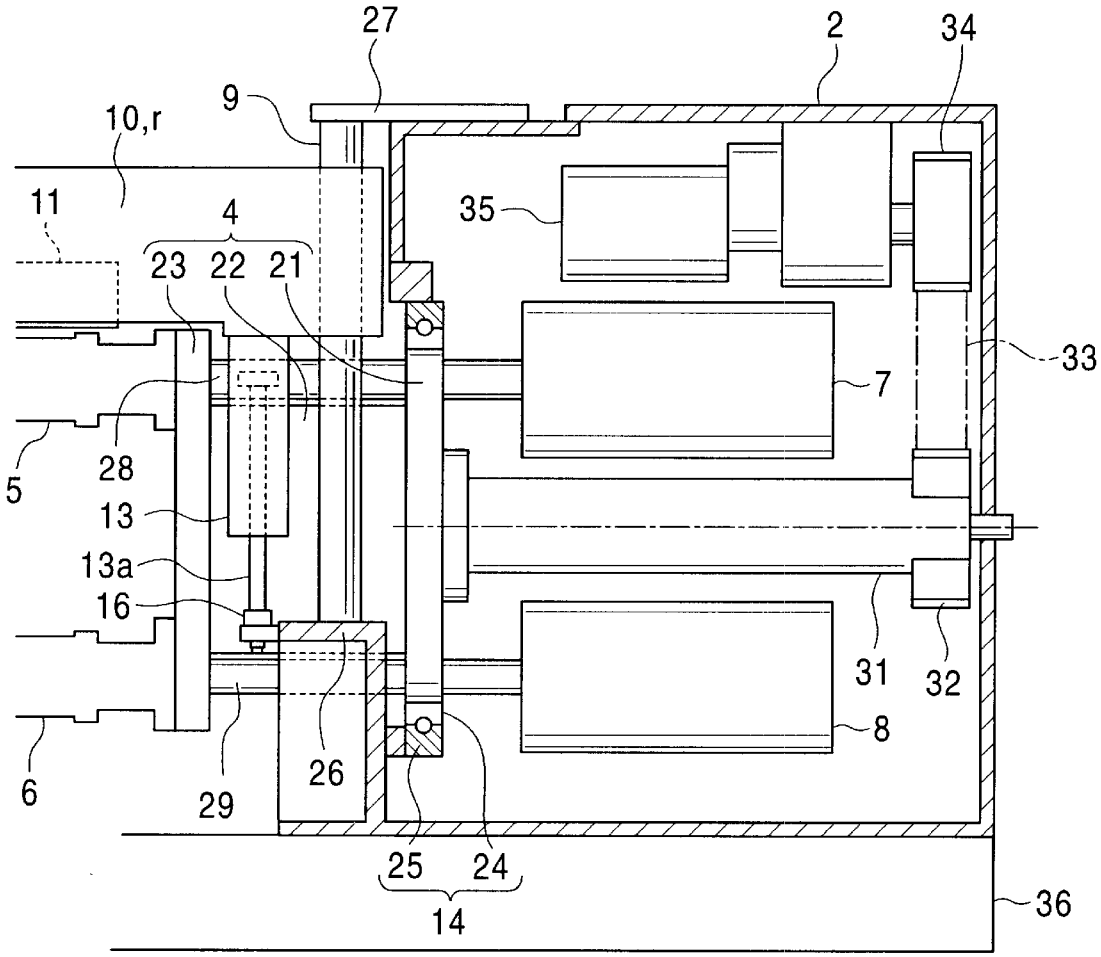
FIG. 1 is a sectional view of the relevant part of a take-up winder.
Figure 2:
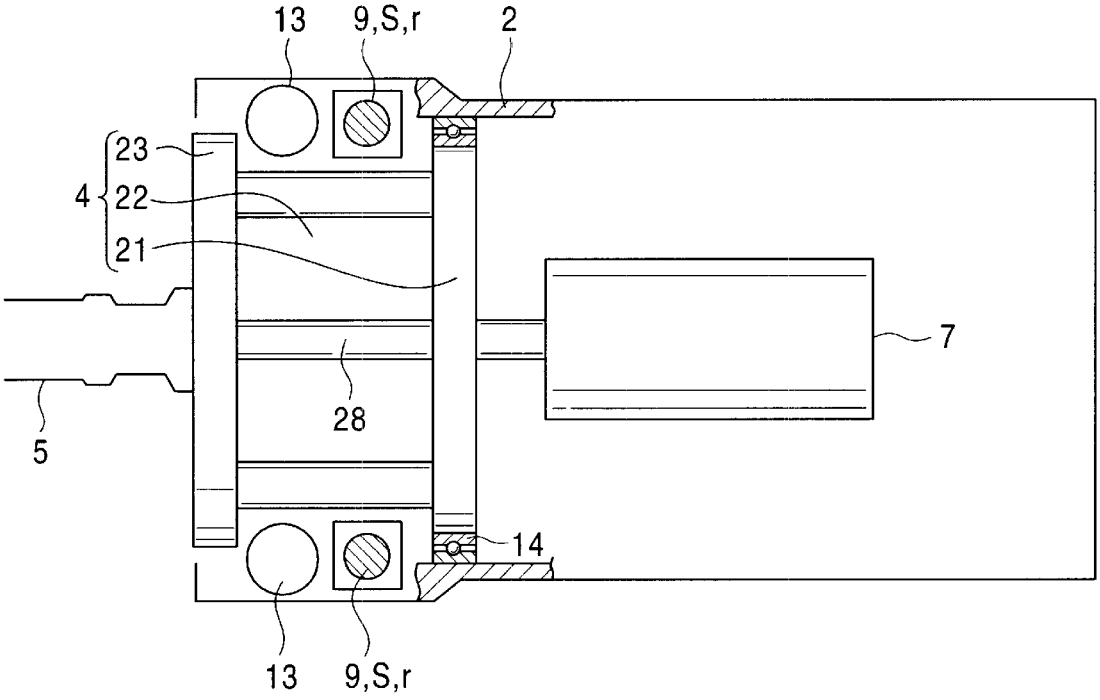
FIG. 2 is a sectional view of the relevant part of the upper surface of the take-up winder.

Referring to FIG. 1 and FIG. 2, the turret 4 is provided with a disk unit 21 to the bearing 14, a body section 22 of narrow diameter, and an attaching section 23 to the bobbin holders 5, 6. A bearing inner ring 24 of the bearing 14 is inserted to the outer periphery of the disk unit 21, and a bearing outer ring 25 of the bearing 14 is attached to the wall of the front side of the machine main body 2.

The guide rod 9 is arranged in a standing condition between a base 26 and a pressing member 27 provided in the machine main body 2. The position of the guide rod 9 is a position next to the position of the bearing 14, a position along the body section 22, and a position with the width narrowed in the range not to interfere with the rotating locus of connecting shafts 28, 29 from the spindle motors 7, 8. In other words, the extent of the minor diameter of the body section 22 can be of any extent if it is within the rotating locus (by the rotation of the turret 4) of the connecting shafts 28, 29.

Referring to FIG. 1, since the guide rod 9 is arranged in a standing condition in the front of the front surface of the machine main body 2, the elevating frame 10 is separated from the front surface of the machine main body 2 and freely elevates or descends. Therefore, the height where the elevating frame 10 is provided can be lowered in the extent not to interfere with the bobbin holders 5, 6. Moreover, referring to FIG. 2, since the guide rod 9 and the contact pressure cylinder 13 are provided in proximity in a row arrangement in the extent not to interfere with the rotating locus (by the rotation of the turret 4) of the connecting shaft 28 of the spindle motor 7, the machine width determined by the interval of the guide rods 9, 9 and the interval of the contact pressure cylinders 13, 13, is to be narrow.

The position of the bobbin holders 5, 6 extends to the front by just the length of the body section 22, and the load of the bearing 14 increases. However, since there are no obstacles for the periphery section of the bearing 14, the bearing 14 of high load can be selected and attached. As a result, the increase in the load to the bearing 14 can be absorbed. Further, 31 is a rotating shaft of the turret 4, 32 is a pulley for the rotating shaft 31, 33 is a belt, 34 is a pulley, and 35 is a motor for rotating and driving. The turret 4 can rotate to the designated position by these members. In addition, 36 is a base where the machine main body 2 is to be placed.

Figure 3:
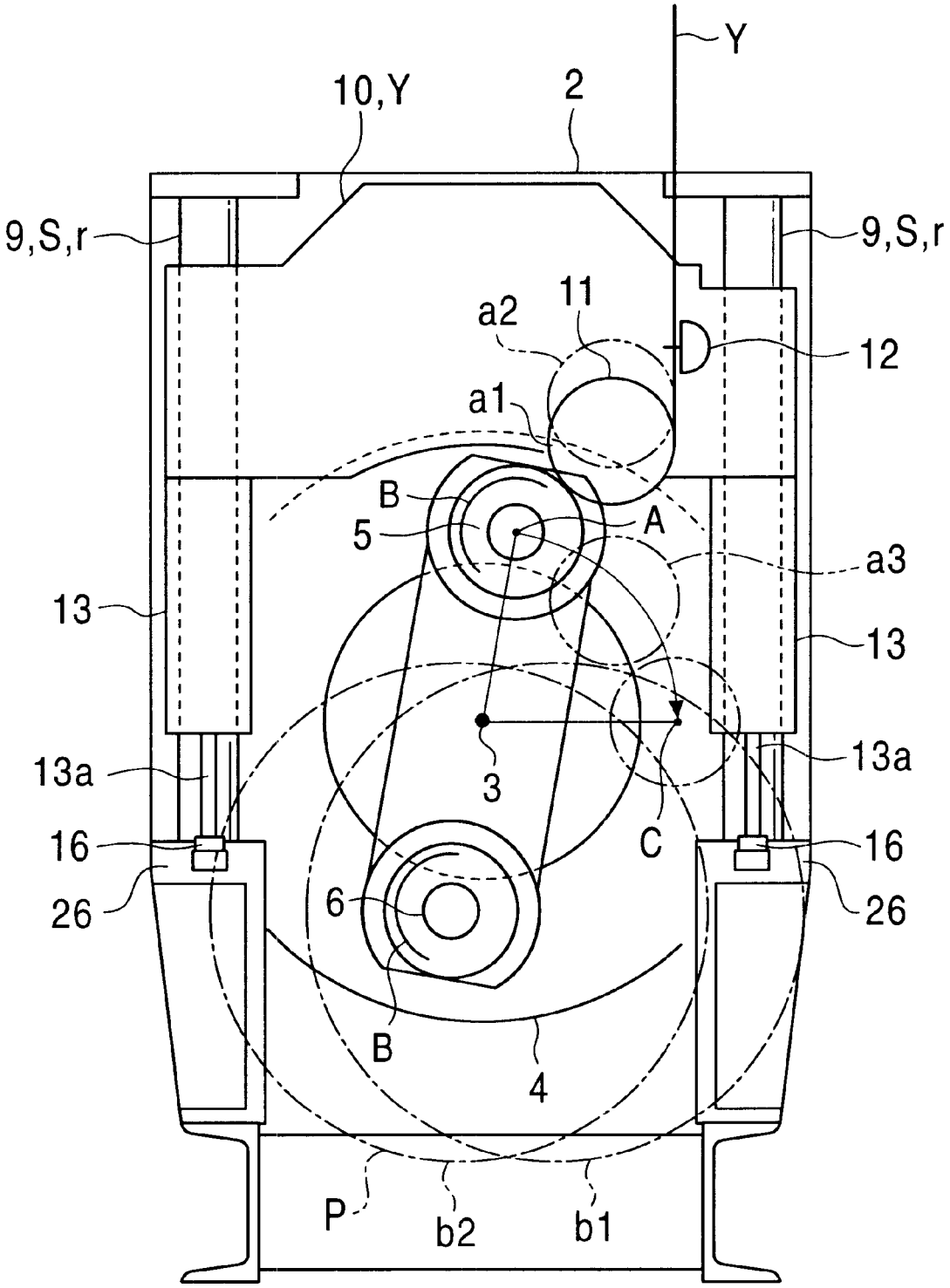
FIG. 3 is a front view of the take-up winder.

Next, referring to FIG. 3, the take-up winder making a full use of the decrease in the machine height by the mechanism of the elevating frame guide will be described.

The contact pressure roller 11 elevates only at the beginning of the winding (until the yarn layer thickness reaches 20 mm), and elevates from a1 position to a2 position. The position A of the bobbin holder 5 is at a fixed position at the time being. The doffing of the full wound package P is carried out during the beginning of the winding. When the doffing is completed, the turret 4 rotates in the clockwise direction, the bobbin holder 5 moves from the position A to the position C, and the contact pressure roller 11 also descends to a3 position. Then, the position of the contact pressure roller 11 is to become in a standstill state at a3 position, and the increase in the winding diameter of the package P is to be released by the rotation of the turret 4 in the clockwise direction. The doffing of the full wound package P at b1 position is carried out eventually.

Then, the turret 4 is rotated slightly, the full wound package P is to be located at b2 position capable of being doffed, and the contact pressure roller 11 is elevated so that a state in which the yarn Y can be threaded to an empty bobbin B set on the bobbin holder 6. Then, a series of operation such that yarn Y is threaded from the full wound package P to an empty bobbin B and the doffing of the full wound package P is carried out, is repeated and a repetitive winding of the yarn Y is carried out.

Further, for a method for releasing the turret 4 according to the increase in the winding diameter, a method for detecting the upper and the lower limit position of the contact pressure roller 11 by a sensor and then rotating the turret 4 intermittently to be settled within the designated upper and lower limit position, a method for calculating the increase in the winding diameter of the package P and rotating the turret 4 automatically, a method for rotating the turret 4 automatically by a designated value of function by an elapse of time, can be given as examples.

Next, the adjusting control of the contact pressure to the package P by the contact pressure cylinder 13 will be described.

The take-up winder 1 comprises a contact pressure control device S for stabilizing the winding condition of the yarn Y by maintaining the contact pressure applied to the package P (hereafter referred to as "winding contact pressure") at a designated value despite the change in the increase of the winding diameter of the package P. In other words, the contact pressure control device S connects a piston rod 13*a* of the contact pressure cylinder 13 and the base 26 of the machine main body 2 side via a load cell (an example of pressure detecting means) 16, and carries out a feedback control for maintaining the detected value of each load cells 16, 16 within a setting range.

Figure 6:
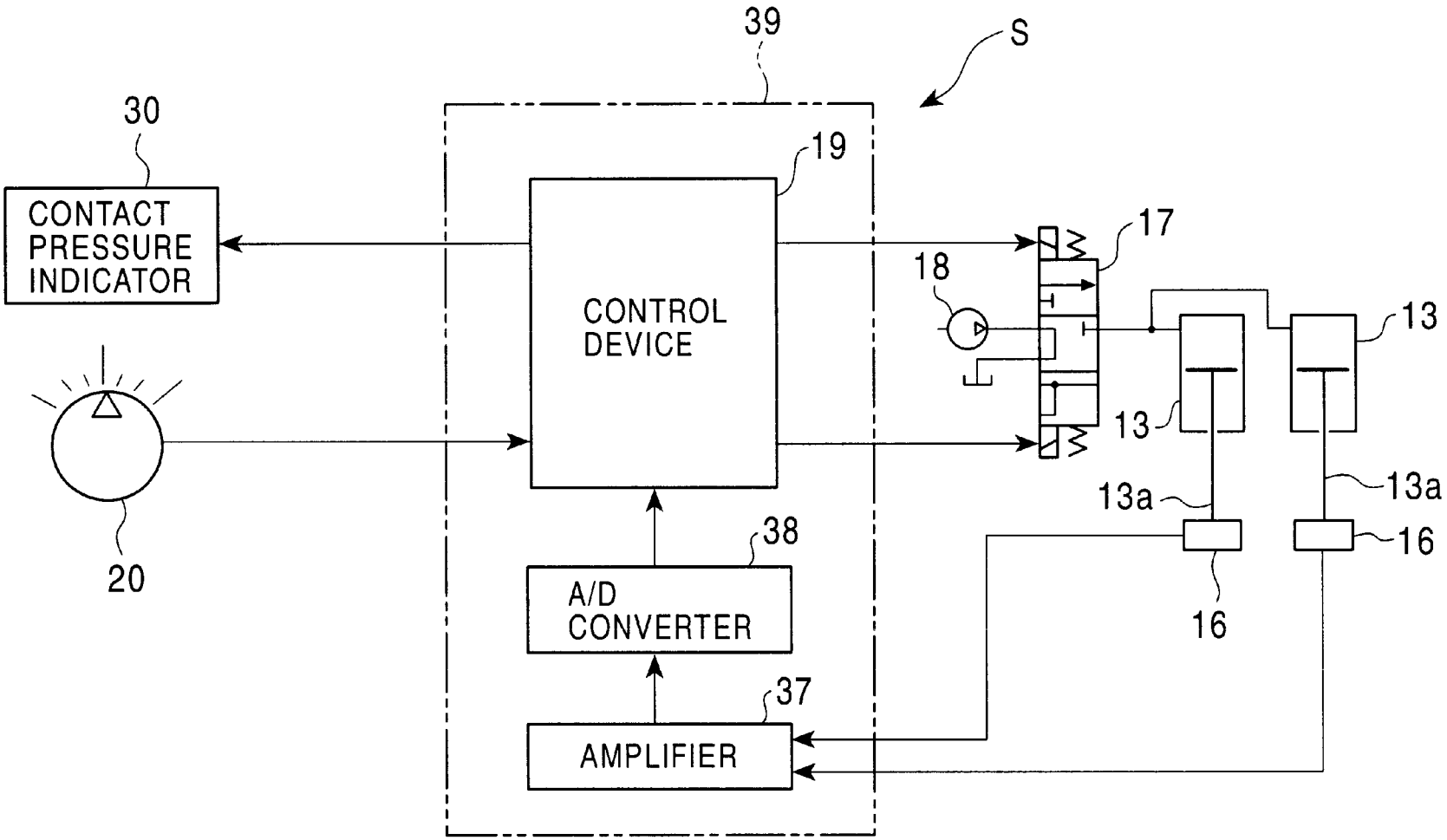
FIG. 6 is a block diagram showing the contact pressure control device.

The contact pressure control device S illustrated in FIG. 6 comprises such as an electromagnetic control valve 17 for controlling the air supply to the contact pressure cylinder 13, an air pump 18 freely supplying compressed air, a control circuit 19, an adjuster 20 for setting the winding contact pressure, an indicator 30 for displaying such as the pressure set in the adjuster 20 or the detected actual pressure, an amplifier 37 for amplifying the signal from the load cell 16, and A/D converter 38 for converting an analog signal from the amplifier 37 into a digital signal and then transmitting to the control circuit 19. The control circuit 19, the amplifier 37, and A/D converter 38 are formed into one as a print circuit board for controlling 39 (an example of a means for controlling the contact pressure adjusting mechanism based on the detected value of the pressure detecting means).

The adjuster 20 sets the winding contact pressure which is to be the target, and it is programmed in that when the target value is set, the upper limit and the lower limit are determined automatically with the target value as the center value. For example, when the target value is to be M and the value between ±3% of the target value M is to be a setting range H, it is controlled to be $0.97\ M \leqq H \leqq 1.03\ M$. Even when the diameter of the package P changes due to the increase in the winding diameter by the feedback control, the winding contact pressure is maintained within the setting range following the change. Moreover, although it is not illustrated in the drawings, the adjuster 20 is formed of an upper limit setting switch and a lower limit setting switch, and it can be made to be able to directly set the setting range H by operating both of these switches.

When:

L: contact pressure of the contact pressure roller 11

W1: weight of the elevating frame 10

W2: total weight of a piston 13*p* and a piston rod 13*a*

F1: thrust (lifting force) of the contact pressure cylinder 13

F2: load acting on the load cell 16, (refer to FIG. 4), $$L=W1-F1$$

$$F2=F1+W2,$$

and $$L=W1+W2-F2 \ldots \quad (1)$$

The value of W1+W2 is fixed beforehand, and when the contact pressure roller 11 is separated to the upper part from the package P of the bobbin B by extending the contact pressure cylinder 13 at maximum level, in other words, when L=0, $$F2=W1+W2 \ldots \quad (2)$$

That is, by extending and working the contact pressure cylinder 13 to the stroke end, despite the winding status of the package P or the presence or the absence of the package P, according to the equation (2), the detected value of the load cell 16 is to be theoretically W1+W2.

Therefore, by comparing the detected value of the load cell 16 when extending and working the contact pressure cylinder 13 to the stroke end, and W1+W2, the zero-point correction of the load cell 16 can be carried out. In other words, an adjusting means (not shown in the drawings) of the load cell 16 is to be operated so that the detected value of the load cell 16 equals W1+W2.

Further, by providing a control valve 17 per each contact pressure cylinder 13, 13, and providing a means for setting the change in the admeasurements of the compressed air to these control valves 17, 17, when there is a margin of error in the detected value of a pair of the load cells 16, 16, to correct the margin of error, the pressure to the pair of the contact pressure cylinders 13, 13 can be adjusted, and the control to correct the elevation strain of the elevating frame 10 can be carried out.

Figure 7:
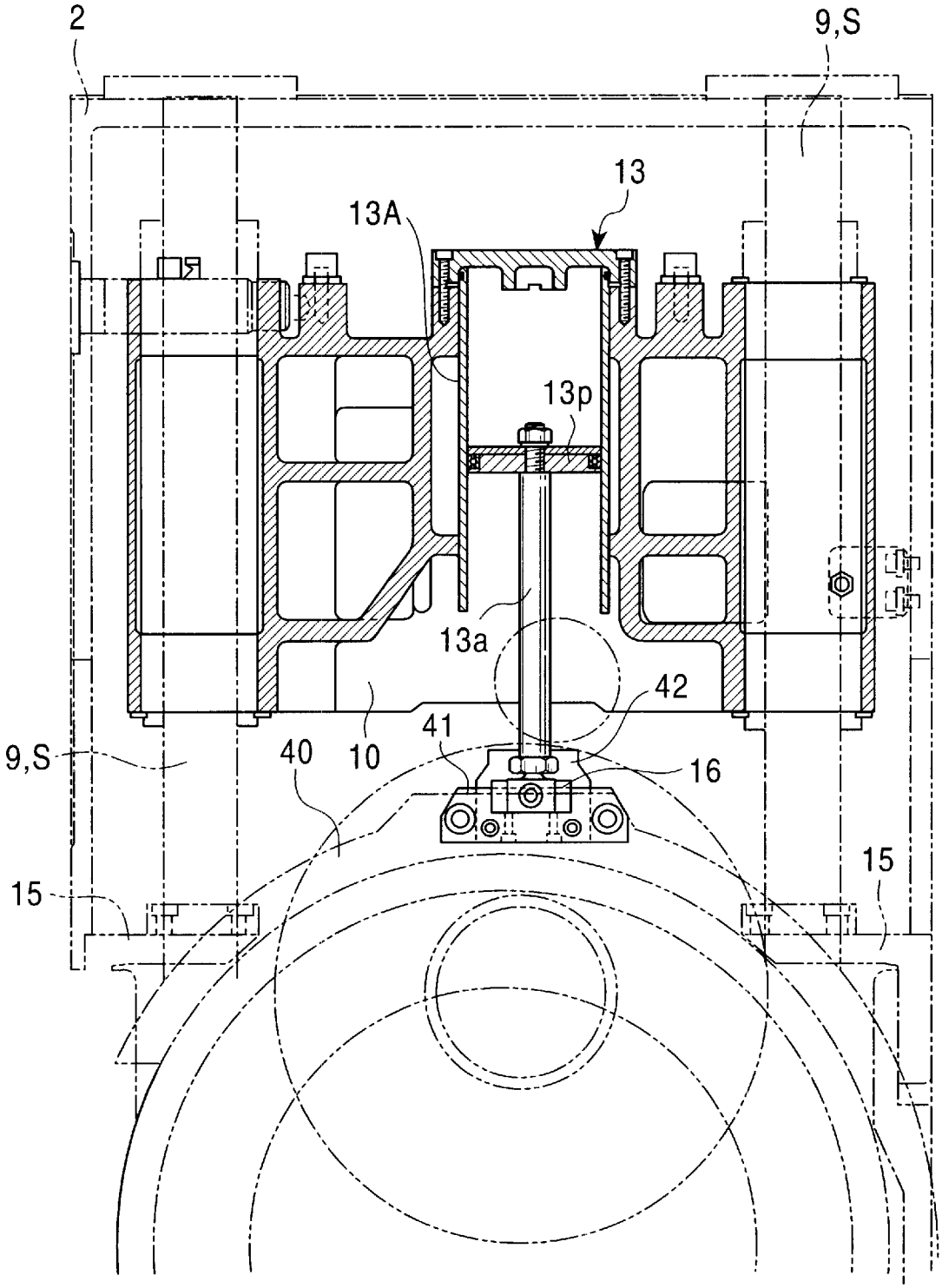
FIG. 7 is a sectional view showing a different configuration of the contact pressure adjusting mechanism.
Figure 8:
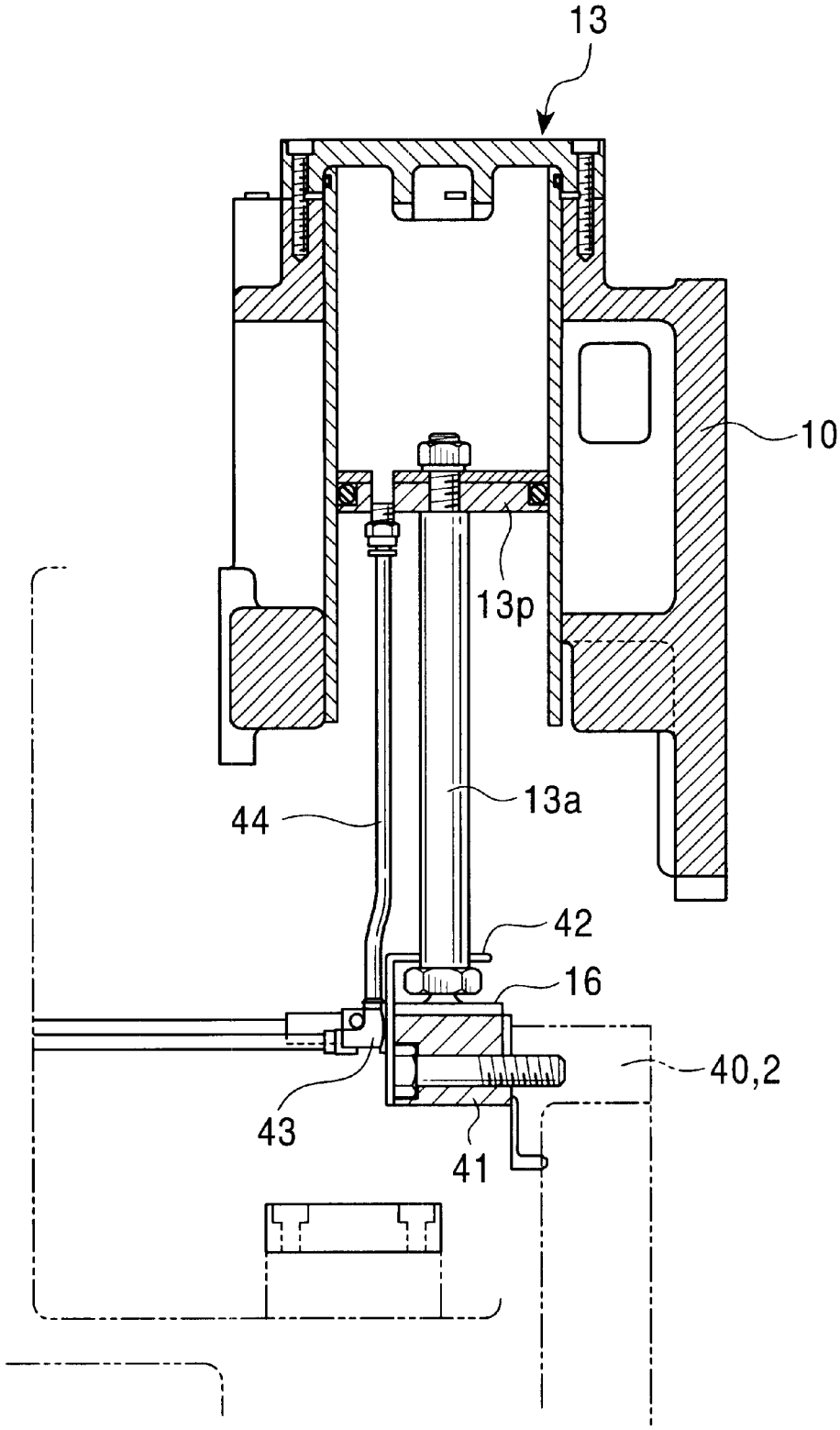
FIG. 8 is a partial diagrammatic view showing the load cell section of FIG. 7.

As shown in FIG. 7 and FIG. 8, the present invention can be applied to a take-up winder for winding a yarn produced by melt-spinning machine 1 of a structure with only one contact pressure cylinder 13 provided. In other words, a bridge frame 40 crossing over a pair of frame members 15, 15 is to be provided, and a single contact pressure cylinder 13 is to be constructed over the bridge frame 40 and the elevating frame 10. The single contact pressure cylinder 13 is to be provided between a pair of the slide supporting mechanisms (s), (s), and the lower edge section of the piston rod 13*a* is to be provided to contact against the load cell 16 placed on a bearer 41 attached by a bolt to a side of the bridge frame 40.

Plumbing to the contact pressure cylinder 13 is formed by connecting a supplying and discharging pipe 44 of the compressed air via an elbow 43 to the hole section of the piston 13*p* from downward. In other words, the supplying and discharging pipe 44 can be piped to the piston 13*p* at the position fixed side. Further, a partition plate 42 is for avoiding the interference of the load cell and the elbow 43, and is fixed to the bearer 41 by a screw.

In such case, only one load cell 16 is required, and comparing to the case in which using two load cells, the whole structure can be formed at a low cost. Moreover, a means for processing two detected values, such as a means for averaging, becomes unnecessary, and the contact pressure control device S can be simplified to this extent.

As shown in FIG. 7 with the imaginary line, the load cell 16 can be provided between the cylinder main body 13A of the contact pressure cylinder 13, and the elevating frame 10. In such case as well, under the condition the contact pressure cylinder 13 acted upon the stroke end of either forward or backward, the total weight of the elevating frame 10 can be worked on the load cell 16 and accordingly the zero-point correction can be carried out.

Figure 9:
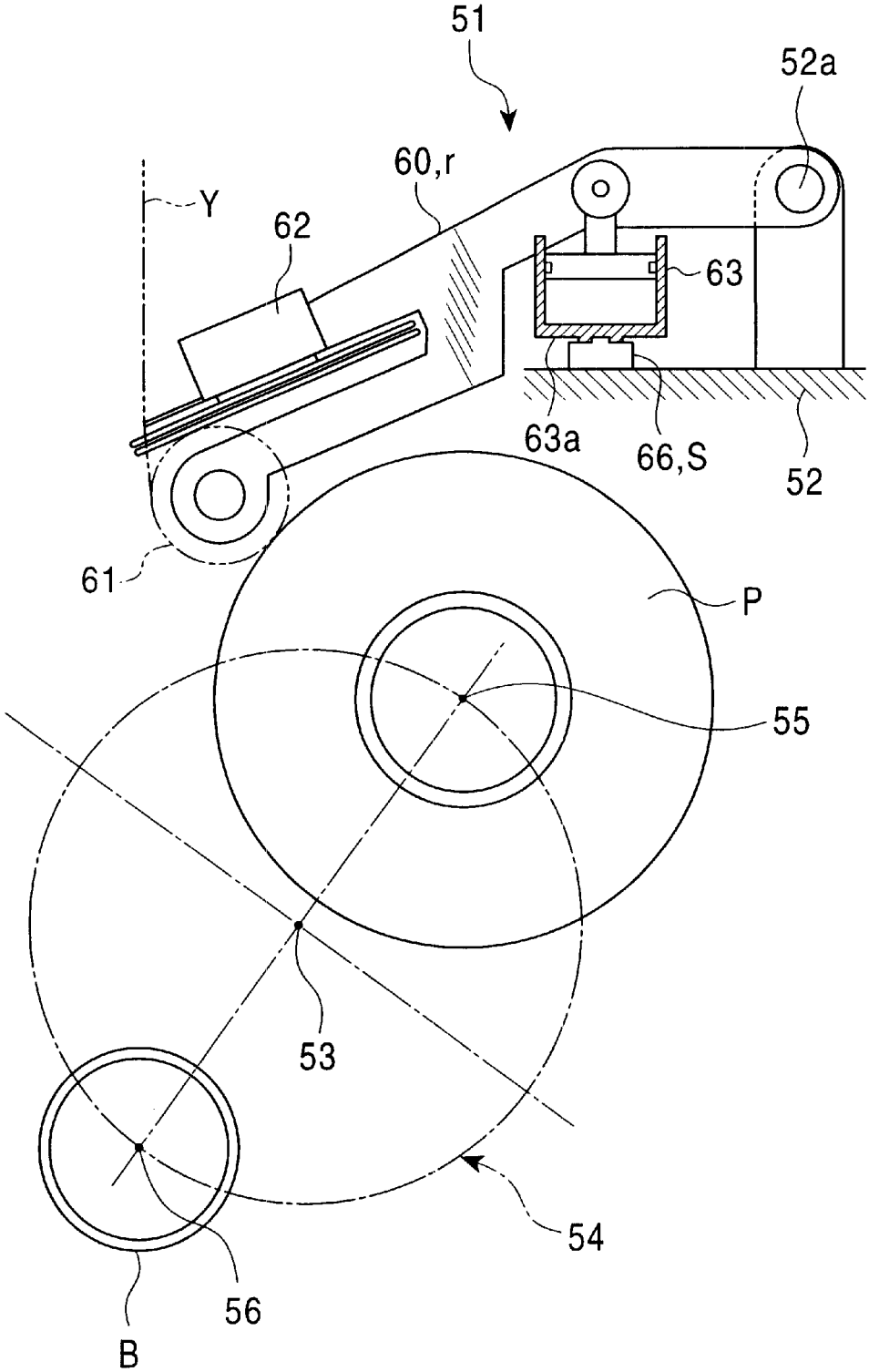
FIG. 9 is a side view showing a different configuration of the contact pressure adjusting mechanism.

As shown in FIG. 9, the present invention can be applied to a take-up winder for winding a yarn produced by a melt-spinning machine 51 of a structure wherein one or a plurality of the contact pressure cylinder 63 is provided between a rotating frame 60 which holds a contact pressure roller 61 rotatable, and a machine main body 52.

The take-up winder 51 comprises a turret 54 rotating around a center shaft 53 to a machine main body 52, two bobbin holders 55, 56 projecting from the turret 54, an induction motor (not shown in the drawings) fixed to the back of the turret 54 for rotating and driving the bobbin holders 55, 56, the rotating frame 60 supported at a fulcrum 52*a* of the machine main body 52 and revolves vertically, a contact pressure roller 61 supported by the rotating frame 60, and a traverse device 62 supported by the rotating frame 60. The traverse device 62 is constructed of a rotary blade traverse device which transfers and traverses yarn between the wings rotating in the opposite direction to one another, and is provided directly above the contact pressure roller 61. The rotating frame 60 composes a transferring frame as a roller supporting means for supporting the contact pressure roller 61 transferable in the direction to contact and separate, to the bobbin.

The weight of the entire rotating frame 60 which supports the contact pressure roller 61 and the traverse device 62, is supported by the contact pressure cylinder 63 provided between the space between the fulcrum 52*a* of a rear anchor of the rotating frame 60 and the contact pressure roller 61, and the machine main body 52. The difference in this weight and the lifting force of the contact pressure cylinder 63 is made to be the contact pressure applied to the package P of the contact pressure roller 61. In other words, the rotating frame 60 which supports the contact pressure roller 61 rotating and contacting to the package P, is made rotatable to the machine main body 52 by the contact pressure cylinder 63. The contact pressure applied to the package P is adjusted by the contact pressure cylinder 63.

Moreover, according to the increase in the winding diameter of the package P to be formed around the bobbin B, the turret 54 rotates gradually in the clockwise direction in the example illustrated in the drawing, and the contact pressure point of the contact pressure roller 61 and the package P is maintained at approximately fixed position. That is, the contact pressure roller 61 is to rotate in the direction to contact and separate with the bobbin B while the entire rotating frame 60 is maintaining the designated contact pressure, and the contact pressure cylinder 63 is made to be a short stroke. Further, the transferring frame is formed of a rotating frame 60, and a roller supporting means (r) is formed of such as a fulcrum 52*a* or the rotating frame 60.

The take-up winder 51 comprises a contact pressure control device S for stabilizing the winding condition of yarn Y by maintaining the contact pressure applied to the package P at a designated value despite the change in the winding diameter of the package P. In other words, the contact pressure control device S connects the cylinder 63*a* of the contact pressure cylinder 63 and the machine main body 52 via the load cell (an example of pressure detecting means) 66, and carries out a feedback control for maintaining the detected value of the load cell 66 within a setting range.

Figure 10:
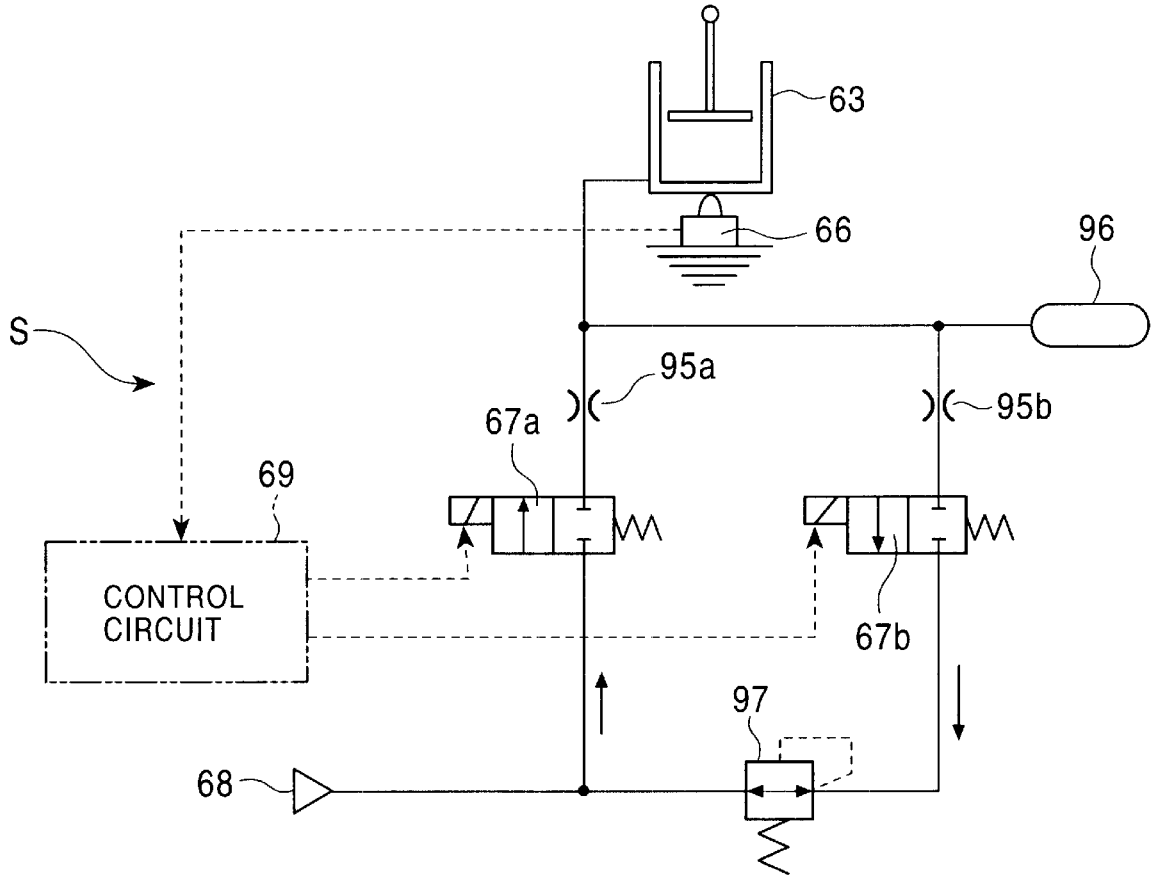
FIG. 10 is a partial diagrammatic view showing the load cell section of FIG. 7.

As shown in FIG. 10, the contact pressure control device S connects a pair of electromagnetic air supplying valve 67*a* and electromagnetic air releasing valve 67*b* for controlling the pressure of the air to be supplied to the contact pressure cylinder 63, to an air source 68. Moreover, the contact pressure control device S outputs the opening and closing order of the air supplying valve 67*a* and the air releasing valve 67*b* from a control circuit 69. The air supplying valve 67*a* and the air releasing valve 67*b* are connected in parallel to the contact pressure cylinder 63, and are also connected in parallel to the air source 68. The air supplying valve 67*a* is connected directly to the air source 68 to form a high pressure line, and the air releasing valve 67*b* forms a low pressure line via a pressure reducer 97. Moreover, in the contact pressure cylinder 63 side of the air supplying valve 67*a* and the air releasing valve 67*b*, squeezes 95*a*, 95*b* are provided respectively, and a common air tank 96 is connected.

As in the same manner with the embodiment described above, the air supplying valve 67*a* opens when the pressure decreases, and the air releasing valve 67*b* opens when the pressure increases, and the air supplying pressure to the contact pressure cylinder 63 is controlled so that to settle within a designated range to the winding contact pressure which is to be the target. Further, other operations of the take-up winder 51 are same as the operations described in FIG. 1 through FIG. 6.

Referring to FIG. 9, since the structure of the rotating frame 60 of the take-up winder 51 is provided with the contact pressure cylinder 63 between the contact pressure roller 61 of the tip and the fulcrum 52*a* of the rear anchor, by the principal of leverage, the load acting on the contact pressure cylinder 63 amplifies according to the length ratio from the fulcrum 52*a*. Moreover, since the contact pressure cylinder 63 is located away from the contact pressure roller 61 or the traverse device 62 which are to be the vibration source, the rotating frame 60 is less subject to the influence of the vibration. Therefore, the minute change in the load of the contact pressure cylinder 63 is detected by the load cell 66.

As in the manner stated above, according to the contact pressure control device of the take-up winder of the present invention, by inventing to detect and feedback the pressure acting upon the contact pressure adjusting mechanism, the control data can be stabilized, and even under the condition in which the vibration is intense due to high speed rotation, a feedback control with precision enduring to a practical use can be carried out.

In the contact pressure control device of the take-up winder, a condition preferable for using the load cell suitable for a relatively large weight detection can be created, and a feedback control superior in the control accuracy under a relatively low cost can be carried out.

According to the contact pressure control device of the take-up winder, only one load cell which is a pressure detecting means is necessary, and there are advantages in that the structure can be simplified and the cost can be suppressed as a control device.

According to the contact pressure control device of the take-up winder, there is an advantage in that a large output power can be drew out from the load cell which is the pressure detecting means.

According to the contact pressure control device of the take-up winder, the zero-point correction of the load cell for further improving the control accuracy becomes practicable, and such condition in which the zero-point correction is practicable can be earned by a simple operation just by working the fluid pressure cylinder on the stroke end of either forward or backward.

Next, according to the take-up winder comprising the pressure detecting means, a method for diagnosing with the pressure detecting means, whether or not an elevation or descending of a slide box with a contact roller is carried out smoothly, will be described.

Figure 15:
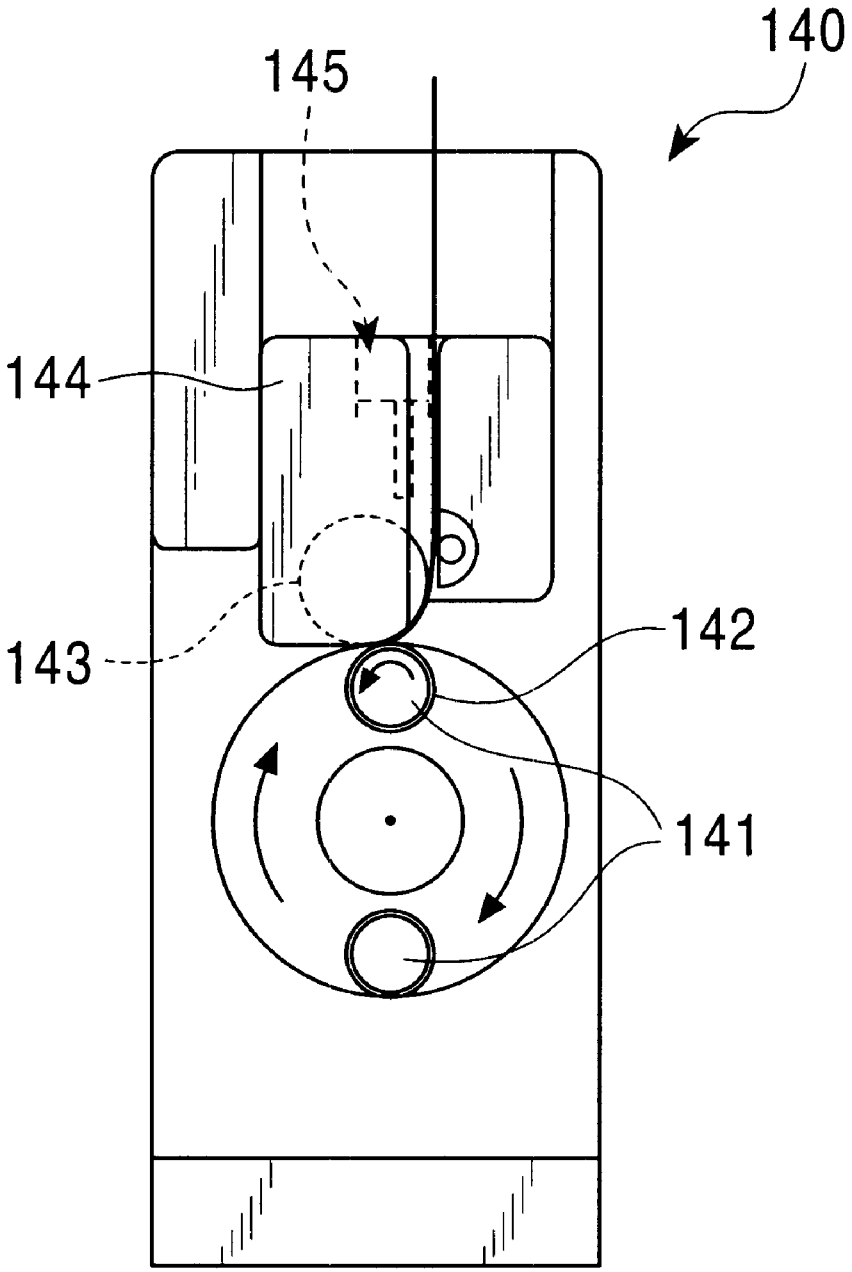
FIG. 15 PRIOR ART
FIG. 15 is a front view of the conventional take-up winder.

As shown in FIG. 15, a take-up winder for winding a yarn produced by a melt-spinning machine 140 holds a plurality of bobbins 142 on a bobbin holder 141 rotating and driving, and a contact roller 143 rotatable is to be pressed down with a designated pressure onto the bobbin 142, a yarn (not shown in the drawings) is to be wound while sandwiched between the bobbin 142.

The contact roller 143 is supported rotatable to a slide box 144 supported capable of sliding in the vertical direction. The slide box 144 elevates accompanying the increase in the winding diameter.

A contact pressure cylinder 145 optimizes the contact pressure acting on the bobbin 142 by sharing the weight of the contact roller 143 with the slide box 144 when the contact roller 143 contacts on the bobbin 142.

Then, by winding the yarn while applying most appropriate contact pressure with the contact roller 143, the yarn can be wound under a consistent designated form.

Since the diameter of a package increases gradually by the winding yarn to the bobbin 142, there is a need for the contact roller 143 to follow the change in the diameter of the package at all times so that the contact pressure is not to be changed. However, there were problems in that when wastes such as dust get stacked in the abrading system of such as a slide bearing (not shown in the drawings) for guiding the slide box 144, a ball (not shown in the drawings) brakes, or the oil runs out, the abrading smoothness of the slide box 144 is lost and the following of the contact roller 143 is worsened.

In such case, there was no means for easily examining whether or not the slide box 144 elevates or descends smoothly. Therefore, in the case of generation of abnormal sound and vibration or winding defects, the cause was searched according to experience or intuition.

Thus, the object of the present invention is to solve the problem mentioned above, and to provide a diagnosing means capable of easily diagnosing whether or not the slide box 144 elevates or descends smoothly, and such diagnostic device.

To accomplish aforementioned object, the present invention measures repetitively the load acting upon the contact pressure cylinder while supplying air to the contact pressure cylinder for fixing the contact pressure of the package and the contact roller, or while releasing air from the contact pressure cylinder, and diagnoses whether or not there is an abnormal resistance in the elevation or descending of the slide box supporting the contact roller according to whether or not the load is within a tolerance range.

A diagnosis can be carried out easily at any time if during the take-up winder is stopping, and it can be judged easily whether or not there is an abnormality in the elevation or descending of the slide box.

Moreover, it is preferable for the diagnostic device to comprise a pressure measuring means for measuring the load acting upon a contact pressure cylinder, and a control unit connected to the pressure measuring means to judge whether or not the measured value of the pressure measuring means is within tolerable level.

According to the present invention, the abnormality in the elevation or descending of the slide box can be easily found with a simple structure.

The preferred another embodiments of the present invention will be described with reference to the accompanying drawings.

Figure 11:
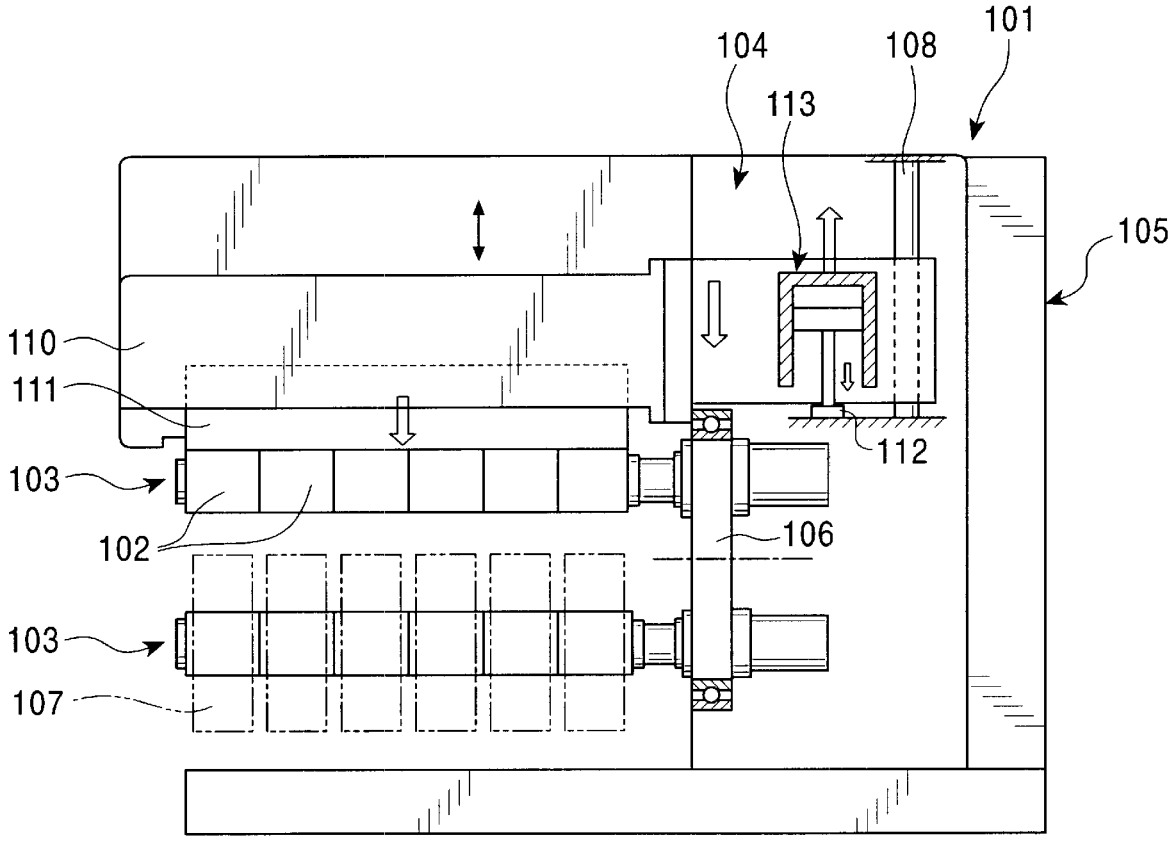
FIG. 11 is a side view of the take-up winder showing a preferred embodiment of the present invention.
Figure 12:
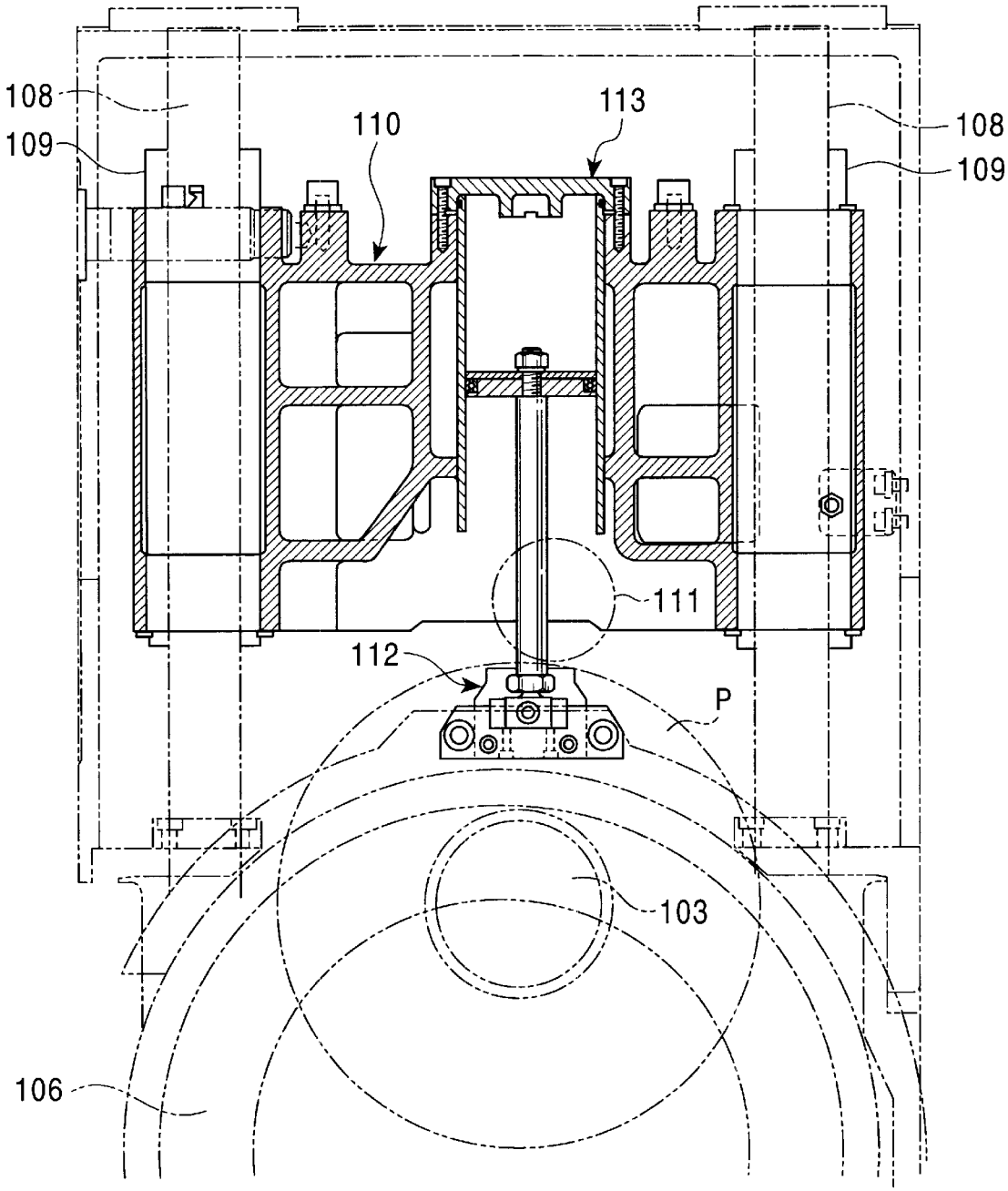
FIG. 12 is an enlarged front view of the relevant part of the take-up winder.

As shown in FIG. 11 and FIG. 12, a take-up winder 101 comprises a bobbin holder 103 for holding a plurality of bobbins 102 arranged in the shaft direction, and a contact pressure device 104 for applying a designated contact pressure to the bobbin 102 of which is in the process of winding a yarn.

Two bobbin holders 103 are provided in the outer periphery section of a turret 106 provided rotatable to a take-up winder main body 105, to project horizontally in the shaft direction respectively. One bobbin holder 103 which holds a full package 107 by rotating the turret 106 during doffing, is moved to a position capable of being doffed. The other bobbin holder 103 which holds an empty bobbin 102 moves to a position capable of winding a yarn.

The contact pressure device 104 comprises a plurality of guide rods 108 provided uprising from the take-up winder main body 105, a slide box 110 provided in a guide rod 108 via a slide bearing 109 which is capable of sliding in the vertical direction, a slide box 110, a contact roller 111 supported rotatable by the slide box 110 which is for applying the contact pressure to the bobbin 102 on the bobbin holder 103, and a contact pressure cylinder 113 for achieving a designated contact pressure provided in the take-up winder for main body 105 via a load cell 112 to be mention below.

The contact pressure device 104 extends to the upper part from the take-up winder main body 105 and supports the slide box 110 from below, and the slide box 110 elevates accompanying the increase in the winding diameter of the package P.

Figure 13:
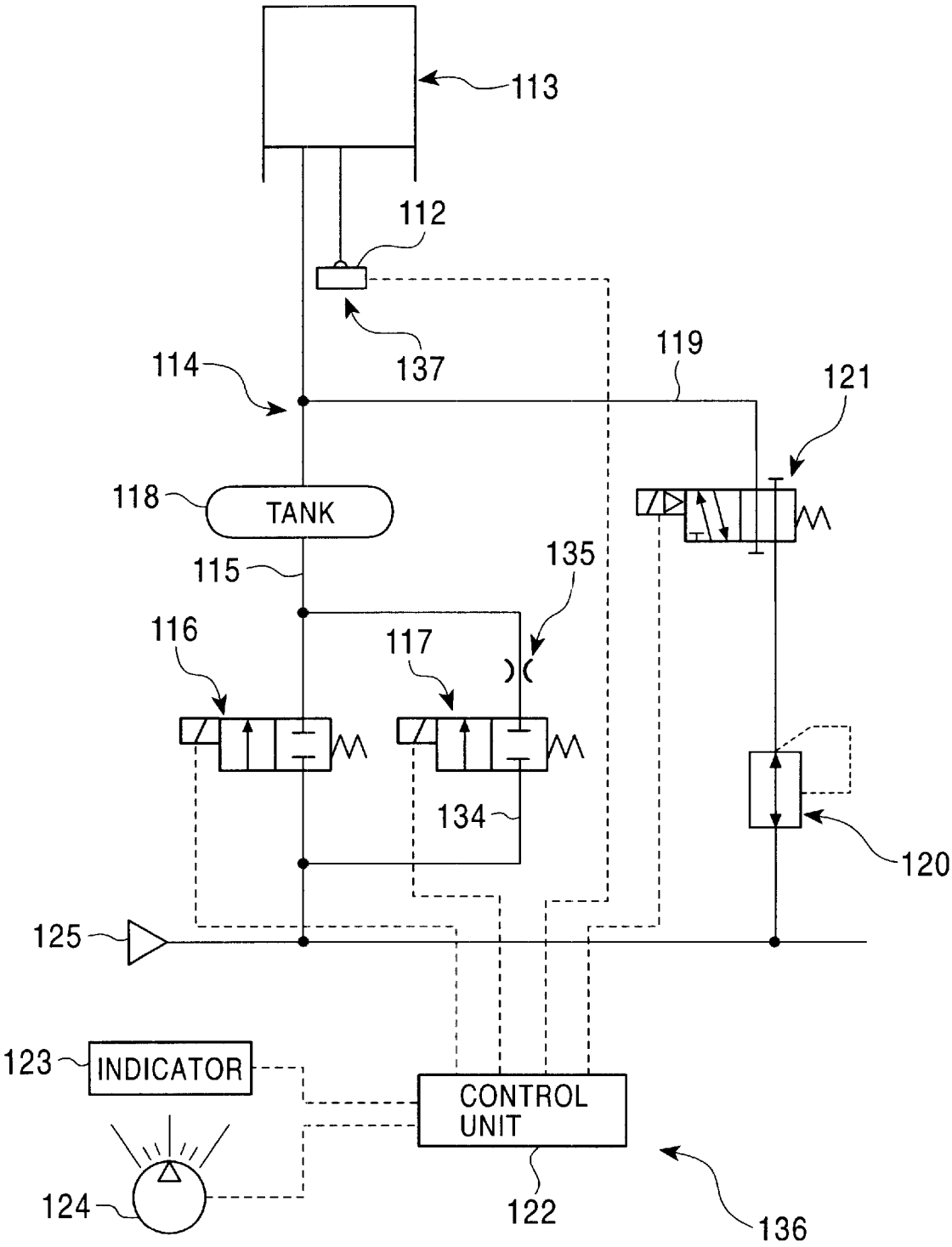
FIG. 13 is a circuit diagram of the diagnostic device.

As shown in FIG. 13, the contact pressure cylinder 113 is a single acting air cylinder, determines the contact pressure by the air being supplied from an air pressure circuit 114.

The air pressure circuit 114 comprises an air supplying path 115 extending from an air source 125 to the contact pressure cylinder 113, electromagnetic control valves for supplying 116, 117 provided in the air supplying path, capable of switching the air supplying path 115 freely opening and closing, a tank 118 provided in the downstream side of the electromagnetic control valves for supplying 116, 117, an air releasing path 119 for releasing air from the contact pressure cylinder 113 connected to the air supplying path 115 so that to branch off from the downstream side of the tank 118, a pressure reducer 120 provided in the air releasing path 119, and an electromagnetic control valve for reducing pressure 121 provided in the air releasing path 119 and switches the air releasing path 119 freely opening and closing at the upstream side of the pressure reducer 120.

The electromagnetic magnetic control valves for supplying 116, 117 comprises an electromagnetic control valve for high speed supplying 116 and an electromagnetic control valve for low speed supplying 117. The electromagnetic control valve for high speed supplying 116 opens the air supplying path 115 all the way when elevating the air pressure inside the contact pressure cylinder 113 promptly. The electromagnetic control valve for low speed supplying 117 is provided in parallel to the electromagnetic control valve for high speed supplying 116, and is used during a contact pressure control.

An orifice 135 is provided in the electromagnetic control valve for high speed supplying 116 and a supply line for low speed 134, and the quantity passed is squeezed. A generation of hunting is prevented by closing the electromagnetic control valve for high speed supplying 116 during the contact pressure control, and switching control the electromagnetic control valve for low speed supplying 117.

Moreover, the contact pressure device 104 comprises a diagnostic device 136 for diagnosing whether or not the elevation or descending transfer of the slide box 110 is carried out smoothly.

The diagnostic device 136 comprises a pressure measuring means 137 provided in the contact pressure cylinder 113 for measuring the load acting upon the contact pressure cylinder 113, a control unit 122 connected to the pressure measuring means 137 for judging whether or not the measured value of the pressure measuring means 137 is within a designated tolerance level, and an indicator 123 connected to the control unit 122 for displaying the judged result output from the control unit 122.

The pressure measuring means 137 comprises a load cell 112, and is provided between the contact pressure cylinder 113 and the take-up winder main body 105. When the contact roller 111 is floated from the bobbin 102 and stands still, the pressure measuring means 137 catches the weight of the contract roller 111, the slide box 110 and the contact pressure cylinder 113.

The control unit 122 is also connected to the electromagnetic control valves for supplying 116, 117 or the electromagnetic control valve for reducing pressure 121. The feedback control to stabilize the contact pressure by the contact roller 111 is carried out by operating the electromagnetic control valve for low speed supplying 117 during winding.

Moreover, the contact pressure of which is to be a target, the weight of the members (not shown in the drawings) or the like attached to the slide box 110 are input beforehand in control unit 122, and an adjuster 124 for carrying out various manual operations is connected thereon.

The effects will be described next.

As shown in FIG. 12, the package P on the bobbin holder 103 located at a designated winding position, winds the yarn while applying a designated contact pressure to the contact roller 111 after winding the yarn with the package P and the contact roller 111 in non-contacting state.

At the time being, by receiving a force to face upward from the contact pressure cylinder 113, the contact roller 111 elevates like continuing to apply the designated contact pressure to the package P following the increase in the winding diameter of the package P. The contact pressure cylinder 113 carries out a feedback control based on the load measured by the load cell 112.

The feedback control is carried out by controlling the opening and closing of the electromagnetic control valve for low speed supplying 117 and the electromagnetic control valve for reducing pressure 121 by keeping the measured value measured by the load cell 112 within a designated target range. The target range is figured out by subtracting the range of the contact pressure which is to be the target, from the weight acting upon the load cell when the contact pressure is not applied to the package P.

When yarn breakage occurs and the winding is interrupted, the diagnosis of whether or not the elevating and descending of the slide box 110 is carried out smoothly is started automatically by utilizing the time until the next yarn threading.

In the diagnosis, it is checked whether or not the load acting upon the load cell 112 is within a designated tolerance level by forwarding the contact pressure cylinder 113.

Figure 14:
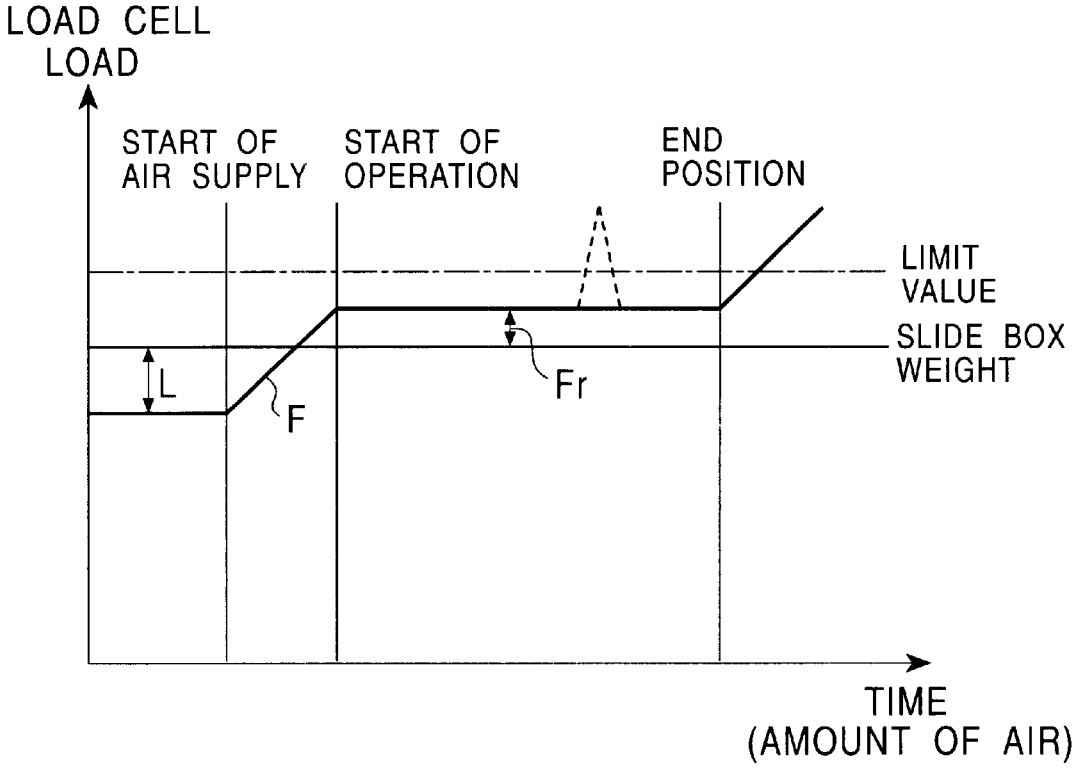
FIG. 14 is a graph showing the load acting on the load cell when supplying air to the contact pressure cylinder.

As shown in FIG. 13 and FIG. 14, the load F applied to the load cell 112 is read accordingly by supplying air at a low speed to the contact pressure cylinder 113 by opening the electromagnetic control valve for low speed supplying 117. When supplying air to the contact pressure cylinder 113 from the state the slide box 110 is located in the lower edge, the load F acting upon the load cell 112, in other words, the measured value of the load cell, increases gradually.

When the slide box 110 starts moving and starts departing from the lower edge, the load F acting upon the load cell 112 elevates to a designated value with abrading resistance Fr added to the weight of the slide box 110 and the contact pressure cylinder 113, and the value is fixed until changes occur in abrading resistance Fr.

Then, as shown with a dotted line in FIG. 14, when the measured value of the load cell 112 exceeds the limit value (tolerance level) set beforehand, before the contact pressure cylinder 113 reaches the upper end, the control unit 122 displays on the indicator 123 the report of the fact that there is an abnormal resistance in the elevation or descending of the slide box 110, along with the measured value.

In such case, since the possibility of some resistance acting upon the elevation of the slide box 110 is large, the contact pressure device 104 is checked in a detail.

Specifically, the following aspects are checked for example, and whether or not a packing (not shown in the drawings) which seals the space between the slide box 110 and the guide rod 108 is deformed or a waste such as dust is stacked therein, whether or not waste is stacked in the slide bearing 109, whether or not a ball (not shown in the drawings) of the slide bearing 109 is broken, whether or not a lubricant has run out in the abrading section of the slide box 110 and the guide rod 108, and whether or not there is an abnormality in the abrading section of the contact pressure cylinder 113. Then, when there is an abnormality, treatment such as repair or exchanging is applied.

Moreover, when the contact pressure cylinder 113 extends to the end without passing the limit value, the control unit 122 displays on the indicator 123 a report that there is no abnormality, the air is released from the contact pressure cylinder 113 which is then returned to the original position, and returns to a state capable of winding.

As in the manner stated above, the load acting upon the contact pressure cylinder 113 is measured repetitively while supplying air to the contact pressure cylinder 113 or while releasing air from the contact pressure cylinder 113 for fixing the contact pressure of the package P and the contact roller 111. According to whether or not the measured load is within a tolerance range, it is checked whether or not there is an abnormal resistance in the elevation or descending of the slide box 110 which supports the contact roller 111. Therefore, it can be checked easily in a short period of time whether or not the elevation or descending of the slide box 110 is being carried out normally. As a result, second disaster such as a defective package P is formed due to the abnormal elevation or descending of the slide box 110, or the package P fall apart during winding, can be prevented from occurring.

Moreover, the diagnostic device 136 comprises the pressure measuring means 137 for measuring the load acting upon the contact pressure cylinder 113, and the control unit connected to the pressure measuring means 137 for judging whether or not the measured value of the pressure measuring means 137 is within the designated tolerance level. Therefore, the abnormality in the elevation or descending of the slide box 110 can be easily found with a simple structure.

Further, the diagnostic device 136 starts operating automatically when yarn breakage occurs, however, it is not to be limited to such condition.

For example, the diagnostic device 136 can be operated by hand by switching the mode from running mode to maintenance mode by the adjuster 124.

In such case, after the slide box 110 is lowered to the lower edge position by opening the electromagnetic control valve for reducing pressure 121, the contact pressure cylinder 113 is extended gradually at a designated low speed by opening the electromagnetic control valve for slow speed supplying 117, and the sequence reading of the load by the load cell 112 is started.

The diagnostic device 136 can check whether or not there is an abnormality in the elevation or descending of the slide box 110 easily at a favorable time.

Moreover, according to the embodiment described above, the load acting upon the load cell 112 is measured repetitively while supplying air to the contact pressure roller 113 (while elevating the slide box 112). However, it is not to be limited to this, and the load acting upon the load cell 112 can be measured repetitively while releasing air from the contact pressure cylinder 113 (while descending the slide box 110).

Moreover, the pressure measuring means 137 comprised of a load cell 112, however, it is not to be limited to only this, it can be of others if it is able to measure the load acting upon the contact pressure cylinder.

In addition, the load acting upon the contact pressure cylinder 113 was measured repetitively while supplying air to the contact pressure cylinder 113 or releasing air from the contact pressure cylinder 113. However, the measurement is not required to be carried out repetitively.

According to the present invention mentioned above, following effect can be eared, and it can be judged easily whether or not the slide box is elevating or descending smoothly.

What is claimed is:

1. A take-up winder comprising:

a bobbin holder;

a contact pressure roller pressed against a bobbin set on the bobbin holder;

a roller supporting means for supporting the contact pressure roller transferable in the direction contacting or estranging to the bobbin; and a contact pressure adjusting mechanism for adjusting a contact pressure between the contact pressure roller and the bobbin;

wherein a pressure detecting means for detecting the pressure acting on the contact pressure adjusting mechanism is provided between said contact pressure adjusting mechanism and a machine main body.

2. A take-up winder comprising:

a bobbin holder;

a contact pressure roller pressed against a bobbin set on the bobbin holder;

a roller supporting means for supporting the contact pressure roller transferable in the direction contacting or estranging to the bobbin; and a contact pressure adjusting mechanism for adjusting a contact pressure between the contact pressure roller and the bobbin;

wherein a pressure detecting means, disposed between said contact pressure adjusting mechanism and a machine main body, for detecting the contact pressure acting on the contact pressure adjusting mechanism, and a means for controlling the contact pressure adjusting mechanism based on the detected value of the pressure detecting means so that the contact pressure is to be maintained at a designated value are also provided.

3. A take-up winder comprising:

a bobbin holder;

a contact pressure roller pressed against a bobbin set on the bobbin holder;

a roller supporting means for supporting the contact pressure roller transferable in the direction contacting or estranging to the bobbin; and a contact pressure adjusting mechanism for adjusting a contact pressure between the contact pressure roller and the bobbin;

wherein a pressure detecting means for detecting the contact pressure acting on the contact pressure adjusting mechanism, a means for controlling the contact pressure adjusting mechanism based on the detected value of the pressure detecting means so that the contact pressure is to be maintained at a designated value are also provided, the contact pressure adjusting mechanism is a fluid pressure cylinder bridged vertically between a machine main body which supports the bobbin holder rotatable, and the roller supporting means, and the pressure detecting means is a load cell provided directly below the fluid pressure cylinder between the fluid pressure cylinder and the machine main body.

4. A take-up winder according to claim 3 wherein the roller supporting means supports a transferring frame which supports the contact pressure roller rotatably, located in the upper part of the bobbin holder, sliding vertically to the machine main body via a pair of slide supporting mechanisms, and the fluid pressure cylinder is provided between the slide supporting mechanisms.

5. A take-up winder according to claim 3 wherein the roller supporting means supports a rear anchor of a transferring frame which supports the contact pressure roller rotatably, located in the upper part of the bobbin holder, rotating to the machine main body, and the fluid pressure cylinder is provided between the transferring frame and the machine main body.

6. A take-up winder according to any one of claim 3 through claim 5 wherein the transferring amount of the fluid pressure cylinder is set so that the total weight of the roller supporting means acts upon the load cell under the condition the fluid pressure cylinder acts upon a forward stroke end or a backward stroke end.

7. A take-up winder for measuring repetitively a load acting upon a contact pressure cylinder while supplying air to the contact pressure cylinder or while releasing the air from the contact pressure cylinder for fixing a contact pressure of a bobbin holder, a package and a contact roller at a designated value, and for diagnosing whether or not there is an abnormality in the elevation and descending of a slide box which supports the contact roller according to the fact of whether or not the load is within a designated tolerance range above a weight of the slide box.

* * * * *